United States Patent [19]

Pearce et al.

[11] 4,018,408

[45] Apr. 19, 1977

[54] CONCAVE PARABOLIC ARCH KITE

[75] Inventors: Peter J. Pearce; Toby J. Cowan, both of Studio City, Calif.

[73] Assignee: Synestructics, Inc., Chatsworth, Calif.

[22] Filed: July 15, 1975

[21] Appl. No.: 596,015

[52] U.S. Cl. ..... 244/153 R

[51] Int. Cl.² ..... B64C 31/06

[58] Field of Search ..... 244/153 R, 154; D34/15 AF; 40/215

[56] References Cited

UNITED STATES PATENTS

| | | | |
|---|---|---|---|
| 1,261,731 | 4/1918 | Fronsdahl | 244/154 |
| 1,328,143 | 1/1920 | Fergusson | 244/153 R |
| 1,490,356 | 4/1924 | Wilder | 244/153 R |
| 2,588,293 | 3/1952 | Roe | 244/153 R |
| 2,737,360 | 3/1956 | Allison | 244/153 R |

*Primary Examiner*—Trygve M. Blix
*Assistant Examiner*—Barry L. Kelmachter
*Attorney, Agent, or Firm*—Kleinberg, Morganstern, Scholnick & Mann

[57] ABSTRACT

A kite having separate forward and aft sails, each arched about a common longitudinal kite axis and each sail disposed concave downward in flight. The concave shape of the sail funnels the wind through the kite. Lift is derived from the central portions of the sail while the lateral portions of the sail, which are nearly vertical and are parallel to the wind direction, provide lateral stability. The proportional lift and weight balance provided by the aft sail, in combination with the bridle arrangement, provide longitudinal stability.

11 Claims, 8 Drawing Figures

CONCAVE PARABOLIC ARCH KITE

BACKGROUND OF THE INVENTION

1. Field of the Invention

The present invention relates to kites and more particularly, a novel kite module that can be flown alone or, in combination with other similar models can be assembled into a complex kite configuration. Both the basic kite and the complex combination kite are easy to fly and are controllable and stable in flight. These favorable flying characteristics are a result of the unique sructure of the kite. The basic kite of the present invention has two aerodynamic surfaces or sails, each sail arched about the same common longitudinal kite axis and each sail opening concave downward.

2. The Prior Art

U.S. Pat. No. 2,737,360 to Allison shows a kite whose sail has a generally cylindrical or conical shape with its axis running longitudinally of the kite and presenting a concave surface downwardly. The Allison kite differs from the present invention both structurally and functionally. The Allison kite typifies a class known as flexible kites, which are flexible in the lateral direction but stiff in the longitudinal direction. The longitudinal stiffness is provided in such kites by longerons, and there are no laterally extending structural members. Such kites are usually attached by the flying string to bridle strings which attach to the kite at laterally opposed points, thereby permitting the kite structure to pivot freely about a lateral axis.

The Allison kite has no fixed shape but assumes a shape depending on the strength of the wind. When there is little wind, the kite assumes a shape which is laterally narrow and flies at a higher angle of attack. When the wind is strong, the Allison kite billows out laterally and flies at a shallow angle of attack. The Allison kite changes its shape in response to gusts having a lateral component so as to maintain stability.

The Allison kite experiences some difficulty in gusty air. It is not unusual for gusts to cause the flexible kite to lose its billowed form or to collapse locally at its leading edge. Severe reverse gusts have caused such kites to turn inside out. In U.S. Pat. No. 3,767,145, Holland shows a simple improvement on the Allison kite which remedies some of the defects. Holland uses longerons which are bowed laterally so that their concave sides are facing each other. This causes the surface of the Holland kite to assume a compound curvature when in flight, which accounts for its different aerodynamic properties.

The Holland kite, like the Allison kite, differs both structurally and functionally from the kite of the present invention. The kite of the present invention is not a flexible kite in the accepted usage of that word. The shape of the sail is maintained by a curved rigid structural member located at the leading edge of each sail, and the kite of the present invention does not billow in any direction including laterally. Its shape is not dependent on the wind velocity. Further, the kite of the present invention lends itself more readily than the flexible kite to the formation of multiple kite structures.

SUMMARY OF THE INVENTION

The basic kite of the present invention includes two sails attached to a rigid frame. The sails conform to a parabolic arched surface whose axis is parallel to the longitudinal direction of the kite. The sails have the shape of a trough with their open, concave side directed forward and downward in flight.

The concave shape of the sail funnels the wind through the kite. Lift is derived from the central portions of the sail while the lateral portions of the sail, which are nearly vertical and are parallel to the wind direction, provide lateral stability. the proportional lift and weight balance provided by the aft sail, in combination with the bridle arrangement, result in great longitudinal stability.

The resulting kite is easier to launch than a flexible kite and is not susceptible to gust-induced collapse while in flight. Further, the kite of the present invention can be used as a module for building multiple-unit kites, which is difficult if not impossible to do with a flexible kite.

Certain structural features of a preferred embodiment of the present kite greatly facilitate assembling the kite from inexpensive pre-formed structural members.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
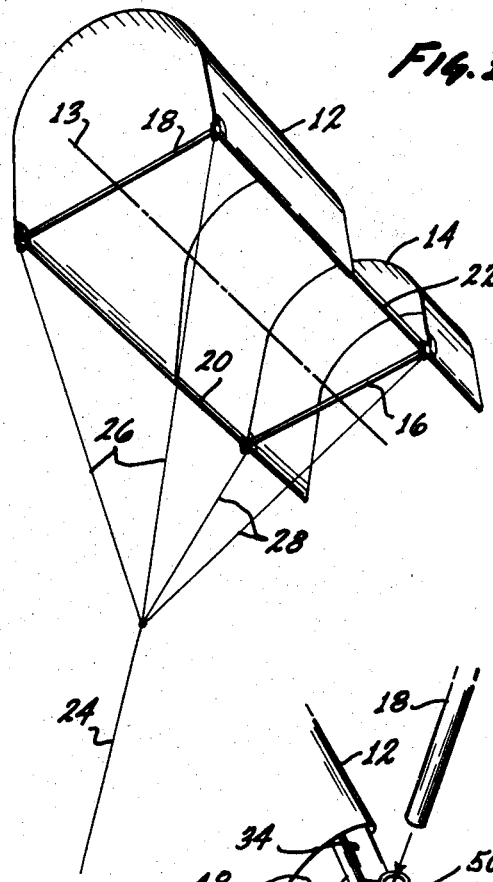
FIG. 1 is a perspective view showing the kite of the present invention in flight.

Referring now to the drawings, in FIG. 1 there is shown a basic kite or module according to the present invention. The kite includes a forward sail 12 and an aft sail 14. These sails are arched about an imaginary common longitudinally directed axis 13, and although they appear to be semi-circular in cross-section, their shape is more accurately described as parabolic in cross-section, conforming to the surface of an imaginary right parabolic cylinder, or arch. In flight these sails are disposed in a substantially concave-downward direction.

The sails 12 and 14 are held in their desired relative position by a substantially rectangular framework 16–22.

The kite is attached to the flying string 24 by a bridle, including in a preferred embodiment a forward bridle string 26 attached at two forward points of the frame of the kite, and an aft bridle string 28 attached at two aft points of the frame of the kite.

Figure 2:
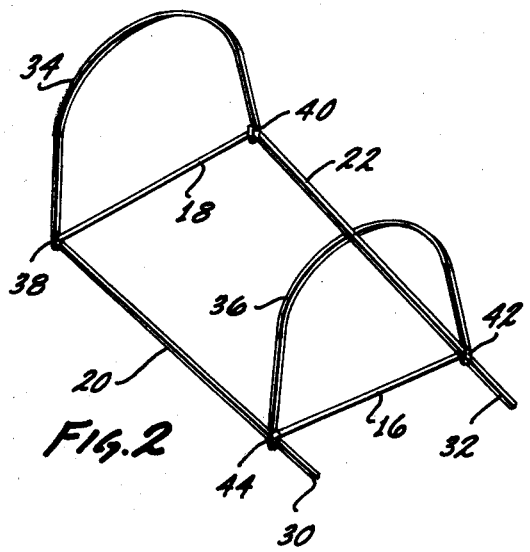
FIG. 2 is a perspective view of the frame of the preferred embodiment.

FIG. 2 shows the structural frame of the preferred embodiment. Longitudinal members 20 and 22 are opposite sides of the generally rectangular frame, and are connected by laterally extending tension members 16 and 18. Longitudinally extending members 20 and 22 extend some distance beyond the aft lateral member 16 forming extensions 30 and 32 respectively. In the preferred embodiment the sails 12 and 14 are supported and given shape by curved members 34 and 36 respectively, which extend along the leading edges of the sails.

The frame described above for the preferred embodiment contemplates sails of a lightweight flexible material such as fabric or plastic film. In other embodiments, the sails 12 and 14 may be formed of a more rigid, shape-holding material, in which case, the curved structural members 34 and 36 could be dispensed with. If the sails 12 and 14 are of a sufficiently stiff material, the lateral tension members 16 and 18 might also be dispensed with, although to achieve this degree of rigidity in the sail would probably result in excessive weight.

Lateral structural members 16 and 18 are referred to as tension members because in the preferred embodiment it is contemplated that curved members 34 and 36 are formed by bowing originally straight members and then bridging their ends by means of the tension members. Thus, in the preferred embodiment, tension members 16 and 18 are always under tension and never compression. therefore, in an alternative embodiment, members 16 and 18 could be replaced by strings or rubber bands.

Figure 3:
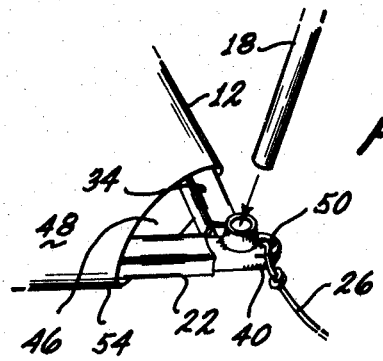
FIG. 3 is a perspective view showing in detail how the frame is connected together and how the sail is attached to the frame in the preferred embodiment.

FIG. 3 shows a detail of the preferred embodiment, specifically that part of the structure at connector 40. Connector 40 joins together longitudinal structural member 22, curved member 34 and tension member 18. Connector 40 also has a hole 50 to which a string 26 may be tied as shown in FIG. 3.

FIG. 3 also shows that sail 12, in the preferred embodiment, consists of a double thickness of a flexible film, having sheets 46 and 48 joined together along their edges, as at 54. The structural members, such as 22 and 34, are inserted between sheets 46 and 48 and extend along the edges where the sheets are joined. To permit the kite to be assembled in this manner, it is necessary that the corners of the sails 12 and 14 be cut in the vicinity of the four connectors 38–44.

Figure 4:
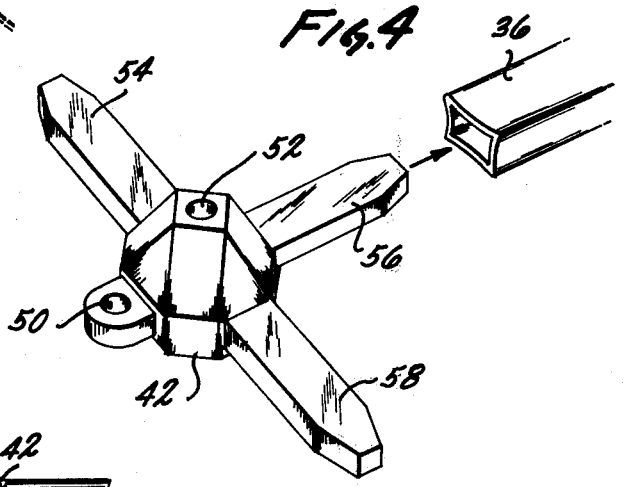
FIG. 4 is a perspective view showing the connectors used in the preferred embodiment.

FIG. 4 is a perspective view of an aft connector such as 42. In a preferred embodiment the connectors are molded from plastic and have the shape shown in FIG. 4. The connector of FIG. 4 differs from that shown in FIG. 3 only in that the connector of FIG. 3 does not have the spoke 54. Structural member 36, which typifies structural members 20, 22, 30, 32 and 34 is a plastic extrusion having substantially a hollow rectangular cross section, whose longer sides are bowed toward each other so as to grip spokes such as 54–58 more tightly.

In general, tension members 16 and 18 have circular cross-section and the connectors therefore have a tightly-fitting circular hole 52 into which the tension members can be slid in the preferred embodiment. In an alternative embodiment the tension members are strings or rubber bands which can be threaded through the hole 52.

It is contemplated that the kite of the present invention will be marketed in the form of a kit containing the sails, struts, connectors, and tension members in a substantially ready-to-assemble form. The use of components having the characteristics described above assures that the kite can be assembled with a minimum of difficulty.

Figure 8:
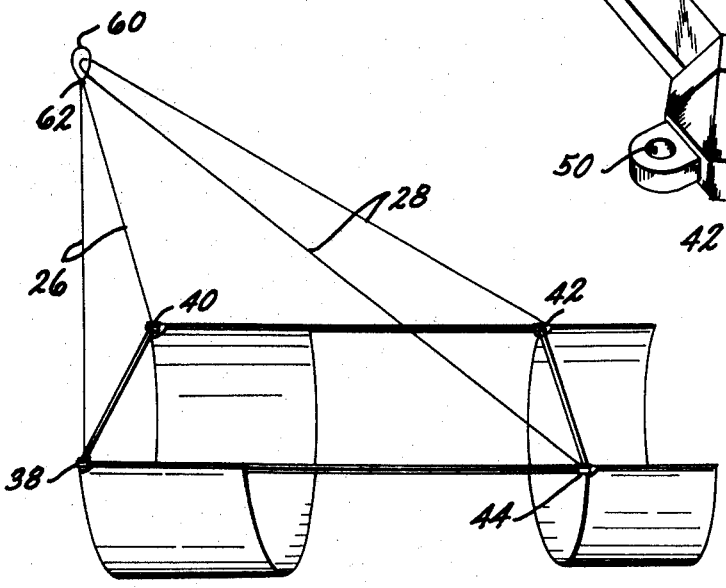
FIG. 8 is a perspective view showing how the bridle strings are attached.

FIG. 8 illustrates the way in which the bridle is formed. A forward bridel string 26 is tied at its ends to connectors 38 and 40. A loop 60 is formed by typing a knot 62 at the center of string 26. Bridle string 28 is passed through loop 60 and the ends of string 28 are tied to connectors 42 and 44. This method of forming the bridle arrangement has proven to be extremely reliable and simple in practice.

Figure 5:
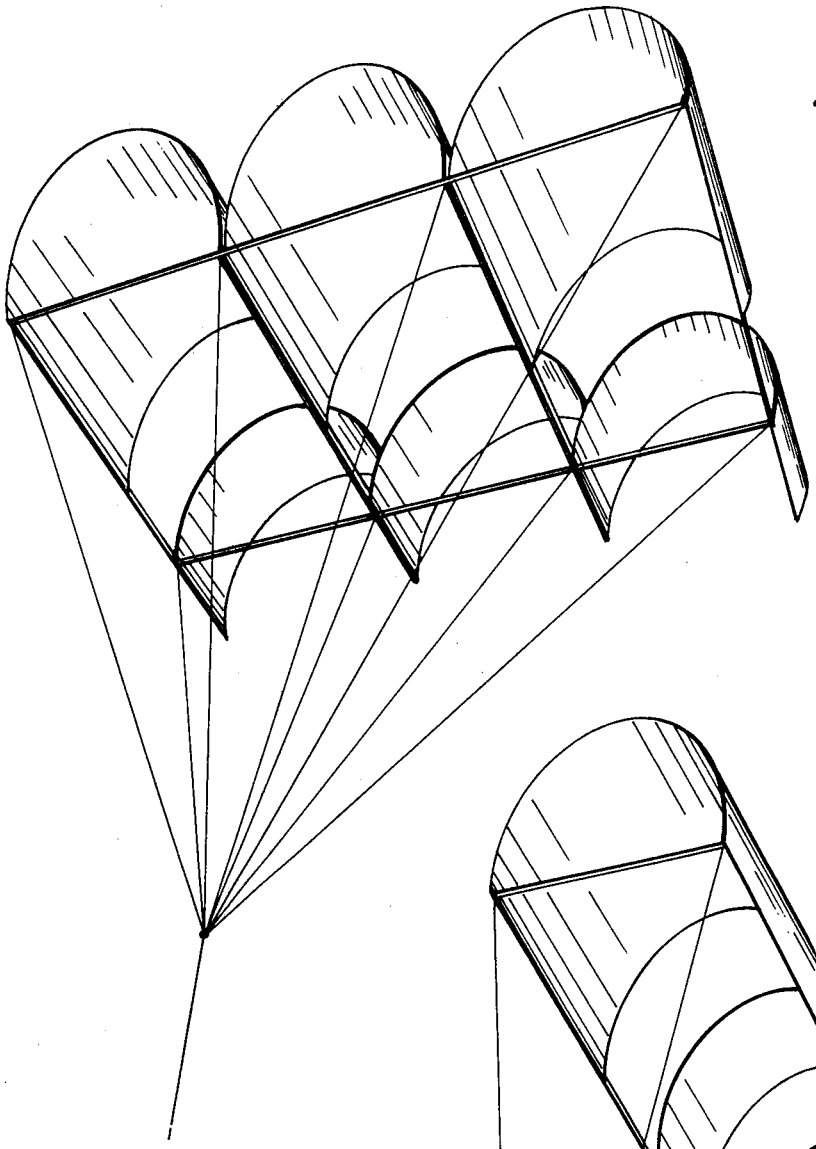
FIG. 5 is a perspective view showing how the basic kite modules may be combined laterally.

FIG. 5 shows how the basic kite module described above can be combined to form a laterally compound kite. Because the connectors were provided with a central hole 52 for receiving the tension members, it is possible in this configuration to use a single triple-length forward tension member in place of the above-described tension member 18, and likewise for aft tension member 16. It is also possible to assemble such compound kites by tying them to each other at adjacent bridle attachment points 50.

Figure 6:
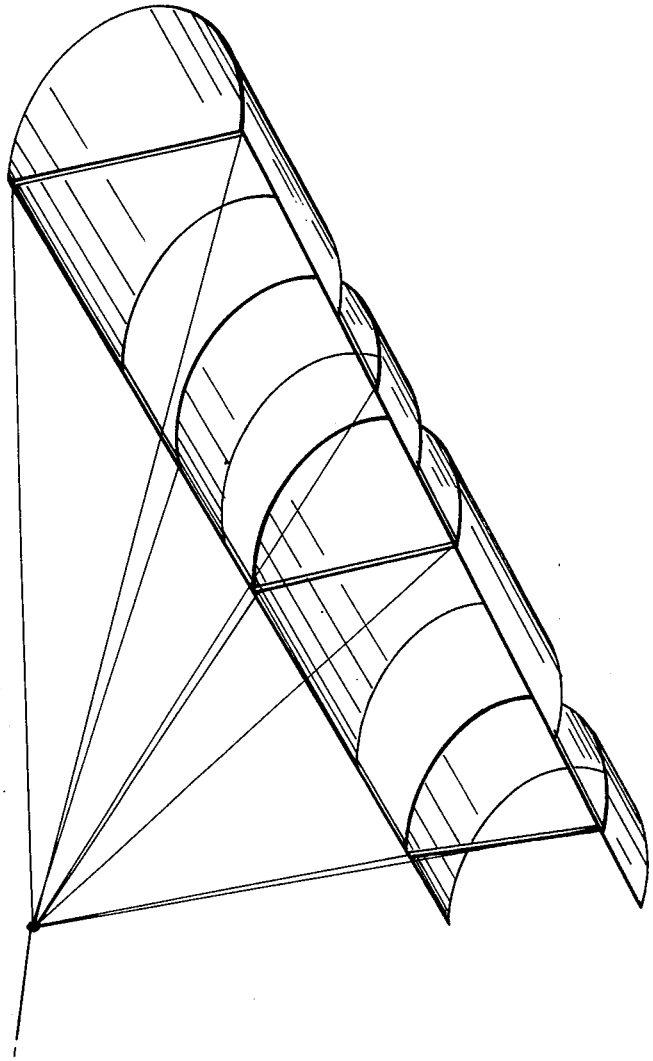
FIG. 6 is a perspective view showing how the basic kite modules may be combined in tandem.

FIG. 6 shows modules of the basic kite combined in the longitudinal direction to form a tandem compound kite. In this configuration it is helpful if all of the connectors are of the 3-pin form shown in FIG. 4.

Figure 7:
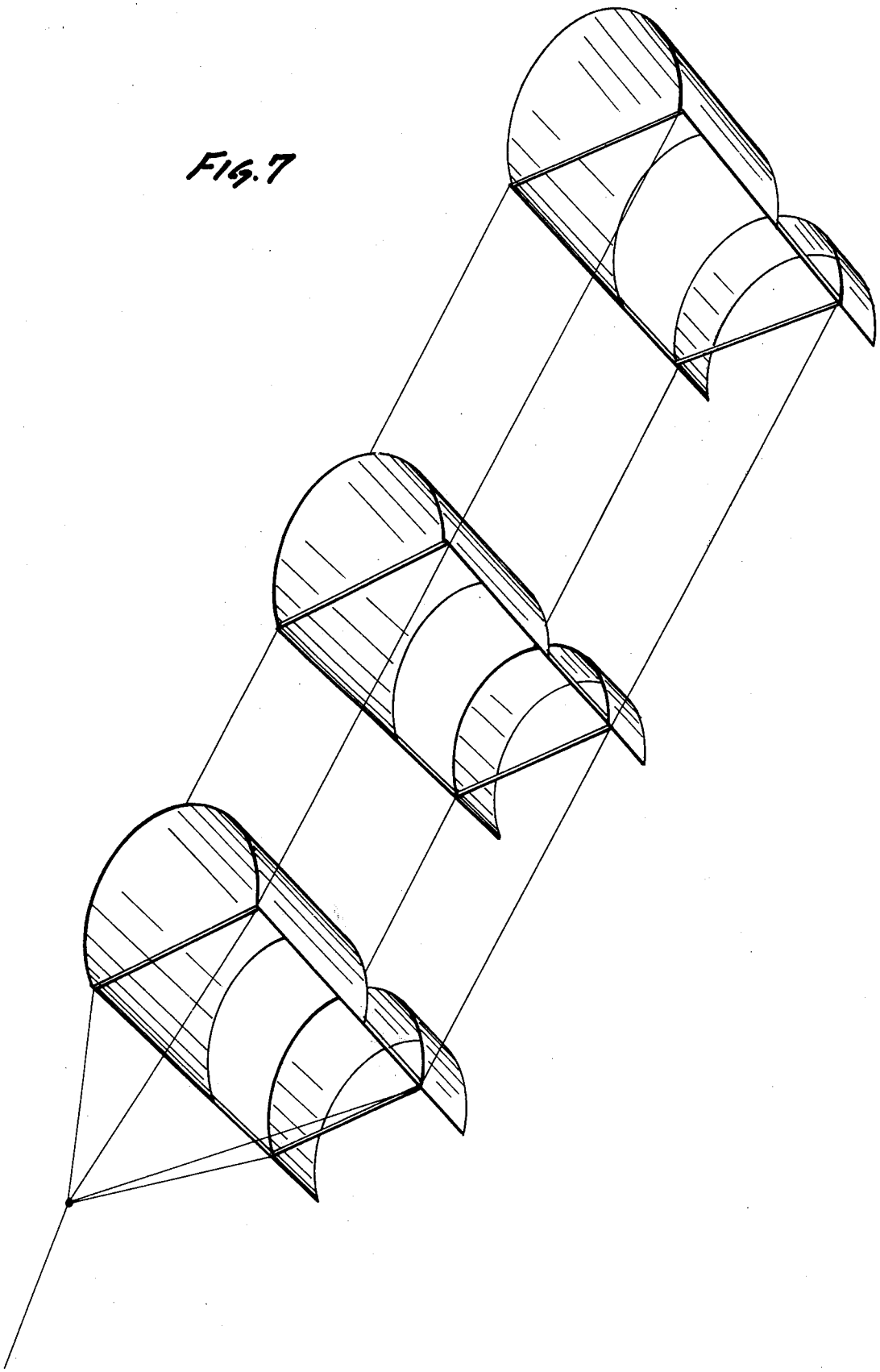
FIG. 7 is a perspective view showing how the basic kite modules may be combined in a train.

FIG. 7 shows a train of kites constructed from the basic kite of the preferred embodiment.

In flight, the kite of the present invention exhibits great stability. This results from its unique design. The scoop-like shape of the sails tunnels the wind through the kite. The center part of the sail contributes the most lift, while the lateral portions of the sail contribute lateral stability and prevent the air from spilling out of the kite over the lateral edges. The aft sail helps to shift the center of pressure and center of gravity down wind of the point of attachment, thereby contributing to the longitudinal stability of the kite.

It has been found that the depth of the concave sail is crucial. If the sail is too shallow, like a dish, the air spills out over the lateral edges and the kite is found to lack stability. On the other hand, if the concave portion is too deep, the kite will be unnecessarily heavy and performance will be reduced. The optimum performance results when the cross-section of the sail is an approximate parabolic arch with side tangent to vertical planes.

Thus, there has been described a rigid kite having the superior flying qualities of the flexible kite while avoiding certain of its disadvantages. In particular, the kite of the present invention is easy to launch and cannot collapse in flight, even in the presence of strong gusts. The kite is easily assembled by means of special connectors and the use of a double-sheeted sail. The kite can be mass-produced economically.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A kite comprising:

at least two sails formed from rectangular sheets disposed about sections of the surface of an imaginary right parabolic arch which extends in forward and aft directions so that a first pair of edges of each sail are parallel to the axis of the arch and colinear and a second pair of edges, forward and aft, of each sail are curved and lie in parallel planes, said sails being separated from each other axially; and, a substantially rectangular frame having a pair of opposite sides to each of which the colinear edges of each sail are secured, the opposite sides extending in the aft direction beyond the end of the rectangle.

2. The kite of claim 1 wherein said sails each further comprise two congruent sheets substantially in contact over their entire surfaces and joined along three of their edges.

3. The kite of claim 2 wherein the corners where said joined edges intersect are cut off, to facilitate construction.

4. The kite of claim 1 wherein said rectangular frame further comprises at least one curved member for each sail, attached to said rectangular frame and lying in planes perpendicular to it, whereby the forward curved edges of said sails are supported in the shape of said imaginary right parabolic arch even when the kite is not in flight.

5. The kite of claim 4 wherein said rectangular frame further comprises at least two connectors for each sail, for attaching said curved members to said rectangular frame and for connecting the sides of the rectangular frame.

6. The kite of claim 5 wherein said connectors further comprise spokes oriented at right angles to each other in a plane, member attaching means for holding a member in tension orthogonal to the plane of the spokes, and string attaching means.

7. The kite of claim 1 further comprising:

a forward bridle string whose ends are attached to the forward corners of said rectangular frame and having a loop at its center;

an aft bridle string threaded through the loop and whose ends are attached to the aft corners of said rectangular frame; and a flying string tied to the loop of the forward bridle.

8. A kite comprising:

a first strut and a second strut;

at least two rectangular sails of thin substantially non-deforming material having equal lengths, each attached along one of its shorter sides to said first strut and each attached along its opposite shorter side to said second strut, said sails being spaced apart along said struts; and, at least one tension member initially parallel to the longer sides of said sails for connecting said struts and drawing them together, whereby said sails are bowed into an arched flight configuration and held in that configuration by said tension member.

9. A kit for constructing a kite, comprising:

a. at least two rectangular sails, each having a forward edge parallel to an aft edge, and each comprising two congruent sheets substantially in contact over their entire surfaces and joined along three of their edges;

b. for each sail, two struts of equal length, and a third strut of length substantially equal to the length of the forward edge of a sail;

c. for each sail, a tension member; and d. for each sail, two connectors for connecting said struts and said tension member.

10. The kit of claim 9 wherein the corners where said joined edges intersect are cut off, to facilitate construction.

11. The kit of claim 9 wherein said connectors further comprise spokes oriented at right angles to each other in a plane, member attaching means for holding a member in tension orthogonal to the plane of the spokes, and string attaching means.

* * * * *